US007771237B2

(12) United States Patent
Lei et al.

(10) Patent No.: US 7,771,237 B2
(45) Date of Patent: Aug. 10, 2010

(54) ELECTRICAL CONNECTOR HAVING A SHELL

(75) Inventors: Gao-Bing Lei, Shenzhen (CN); Nan Hu, Shenzhen (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/499,685

(22) Filed: Jul. 8, 2009

(65) Prior Publication Data

US 2010/0009572 A1 Jan. 14, 2010

(30) Foreign Application Priority Data

Jul. 8, 2008 (CN) ..... 2008 2 0040694

(51) Int. Cl.
*H01R 9/03* (2006.01)

(52) U.S. Cl. ..... 439/607.54; 439/660

(58) Field of Classification Search ..... 439/607.54, 439/607.31–607.4, 607.41–607.49, 607.01, 439/660

See application file for complete search history.

(56) References Cited

U.S. PATENT DOCUMENTS 6,165,016 A * 12/2000 Lai ..... 439/607.41
6,193,552 B1 * 2/2001 Chiou et al. ..... 439/607.35
6,224,422 B1 * 5/2001 Zhu et al. ..... 439/607.01
6,270,379 B1 * 8/2001 Huang et al. ..... 439/660
6,383,024 B1 * 5/2002 Wang et al. ..... 439/607.23
6,398,587 B1 * 6/2002 Chen et al. ..... 439/607.35
6,416,359 B1 * 7/2002 Zhang et al. ..... 439/607.37
6,419,529 B1 * 7/2002 Shi et al. ..... 439/701
6,503,102 B1 * 1/2003 Zhang et al. ..... 439/607.55
6,793,531 B1 * 9/2004 Zhang ..... 439/607.04
7,150,651 B1 * 12/2006 Yuan et al. ..... 439/604.54
7,273,397 B2 * 9/2007 Watanabe et al. ..... 439/607.27
7,422,465 B2 * 9/2008 Watanabe et al. ..... 439/353
7,422,488 B1 * 9/2008 Wu ..... 439/676
7,473,136 B2 * 1/2009 Hu et al. ..... 439/607.01
7,534,141 B1 * 5/2009 Wu ..... 439/607.01
2006/0141845 A1 * 6/2006 Hu et al. ..... 439/350
2006/0148300 A1 * 7/2006 Huang et al. ..... 439/353
2007/0099504 A1 * 5/2007 Wu ..... 439/607
2007/0149054 A1 * 6/2007 Watanabe et al. ..... 439/607
2008/0200058 A1 * 8/2008 Tsai ..... 439/353
2009/0042421 A1 * 2/2009 Zheng et al. ..... 439/83

* cited by examiner

*Primary Examiner*—Hae Moon Hyeon
*Assistant Examiner*—Vladimir Imas
(74) *Attorney, Agent, or Firm*—Andrew C. Cheng; Wei Te Chung; Ming Chieh Chang

(57) ABSTRACT

An electrical connector includes an insulative housing (1), a number of terminals (2) received in the housing and a shell (3) covering the housing thereby forming a receiving space (310). The insulative housing (1) defines a base portion (11), a tongue portion (12) extending frontward from the base portion and having numbers of passageways (19) receiving the terminals and extending through the base portion. The shell (3) include a pair of pressing portions (36) extending to the receiving space and pressing against said tongue portion (12) in a direction perpendicular to the tongue portion.

20 Claims, 4 Drawing Sheets

ELECTRICAL CONNECTOR HAVING A SHELL

BACKGROUND OF THE INVENTION

1. Field of the Invention

The present invention relates to a electrical connector having a shell.

2. Description of the Related Art

With current electronics technology, a normal micro USB electrical connector includes an insulative housing with a tongue portion protruding forward for connecting a mating connector, a plurality of terminals received in the housing, and a shell covering an outside of the housing. The insulative housing has a plurality of grooves extending to the tongue portion and receiving the terminals. The tongue portion is extending form a base portion and thinner than the base portion, which forms a receiving space cooperating with the shell. But the tongue portion must define plurality of grooves for receiving the terminals, so it is easily distorted in molding process and do not exactly electrically connect with the mating connector.

Therefore, an improved electrical connector is desired to overcome the disadvantages of the related arts.

SUMMARY OF THE INVENTION

An object of the present invention is to provide an electrical connector overcoming disadvantage of the insulative housing distorted.

In order to achieve above-mentioned object, an electrical connector in accordance with a preferred embodiment of the present invention includes an insulative housing, a number of terminals received in the housing and a shell covering the housing thereby forming a receiving space. The insulative housing defines a base portion, a tongue portion extending frontward from the base portion and having numbers of passageways receiving the terminals and extending through the base portion. The shell include a pair of pressing portions extending to the receiving space and pressing against said tongue portion in a direction perpendicular to the tongue portion.

Other objects, advantages and novel features of the invention will become more apparent from the following detailed description of the present embodiment when taken in conjunction with the accompanying drawings.

DETAILED DESCRIPTION OF THE INVENTION

Figure 1:
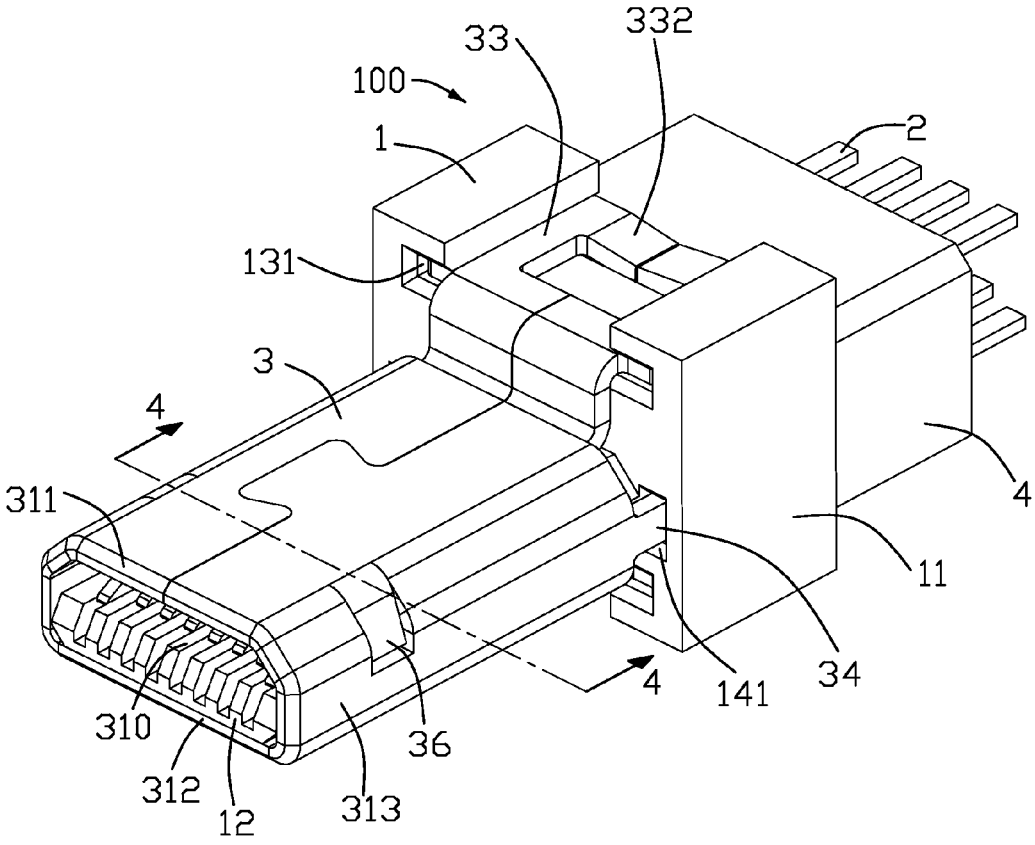
FIG. 1 is a perspective view of an electrical connector in accordance with the preferred embodiment of the present invention.

Reference will now be made to the drawing figures to describe the preferred embodiment of the present invention in detail.

Referring to FIG. 1, an electrical connector 100 in accordance with the present invention includes an insulative housing 1, a plurality of terminals 2 retained in the insulative housing, a shell 3 covering the insulative housing and a spacer 4 covering one end of the insulative housing.

Figure 2:
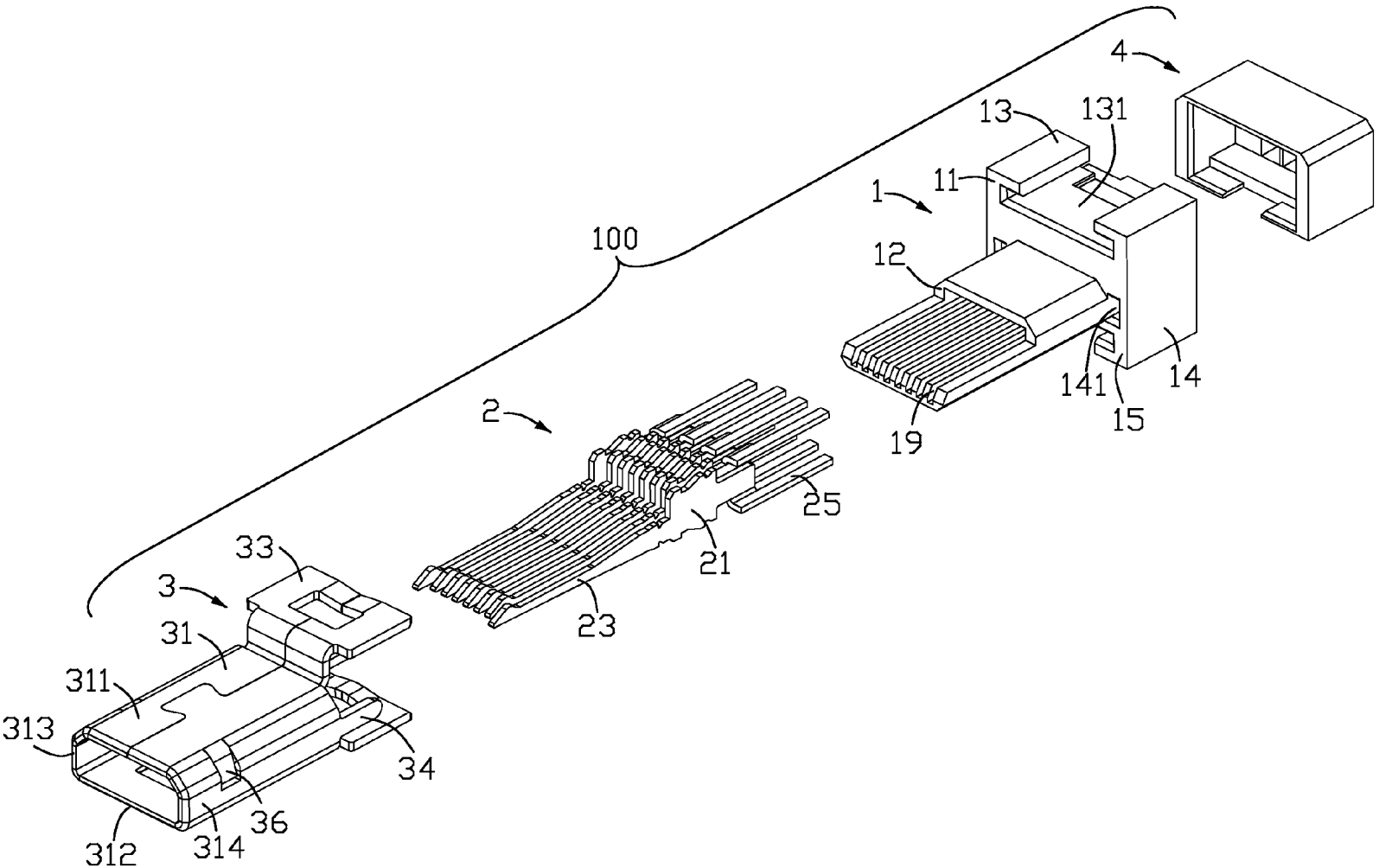
FIG. 2 is an exploded perspective view of the electrical connector of FIG. 1.
Figure 3:
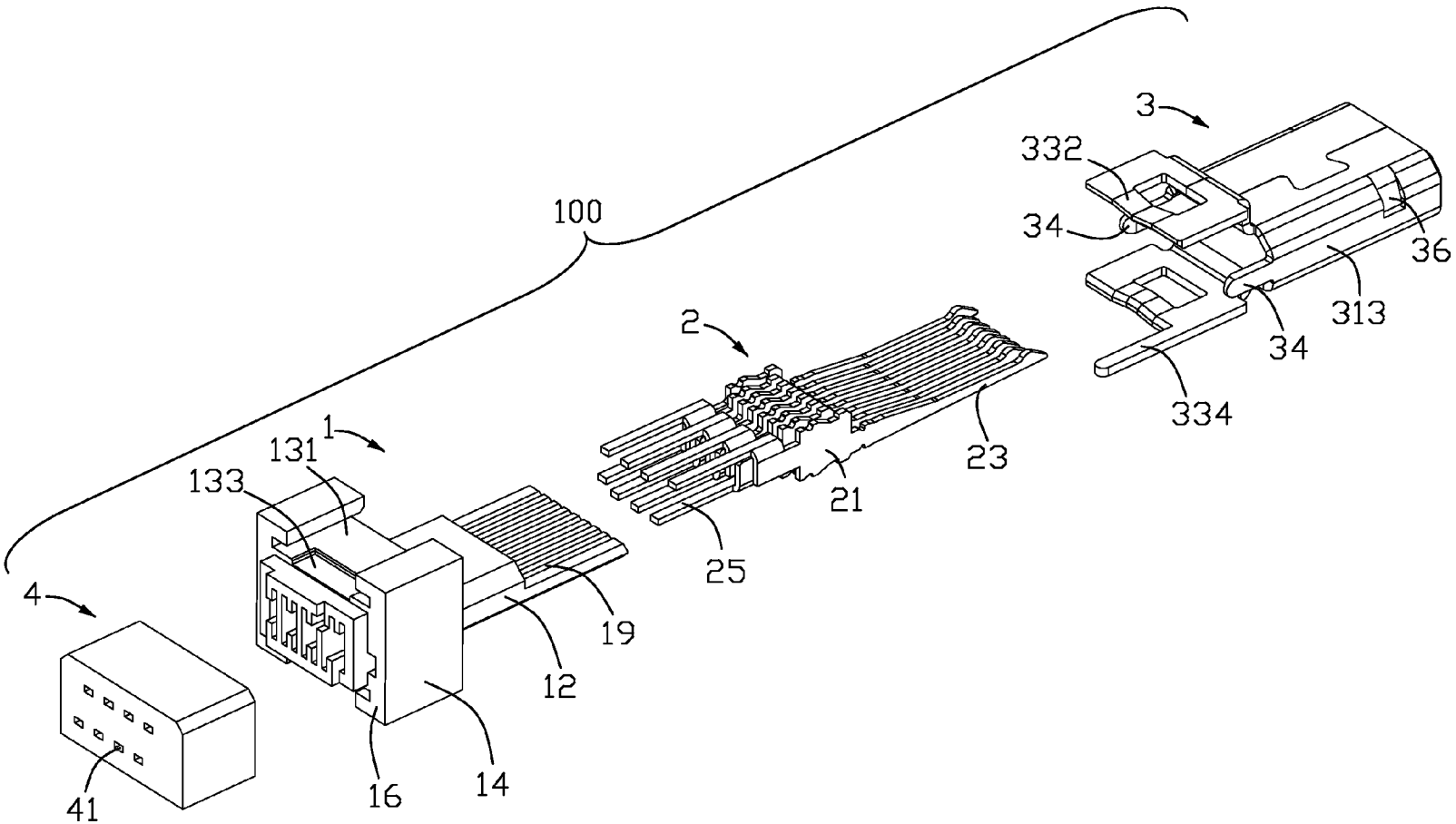
FIG. 3 is another exploded perspective view of the electrical connector of FIG. 1.

Combination with FIGS. 2 and 3, the insulative housing 1 defines a base portion 11, a tongue portion 12 extending frontward from the base portion in a rear-to-front direction. The cube-shaped base portion 11 includes two horizontal portions 13 consisting of an upper portion and a bottom portion, two upright portions 14 including a left portion and a right portion, a front end 15 and a rear end 16. The insulative housing 1 has a plurality of passageways 19 extending through the base portion 11 and the tongue portion 12 along the rear-to-front direction, and the terminals 2 are frontward inserted into the passageways 19 from the rear end 16.

The shell 3 is rearward installed to the insulative housing 1. The horizontal portion 13 has a T-shaped slot 131 opening upwards viewed from the front side. The upright portion 14 includes a hole 141 extending through the front end 15. The shell 3 includes a body portion 31 shielding the tongue portion 12 thereby forming a receiving space 310, a pair of locking portions 33 respectively received in the slot 131 for engaging with the base portion 11 and a pair of retaining tails 34 extending rearward from the body portion for being retained into the hole 141. The locking portion 33 has a stopping portion 332 received in a recessing portion 133 in the slot 131 for preventing the shell 3 from leaving the insulative housing frontward.

Figure 4:
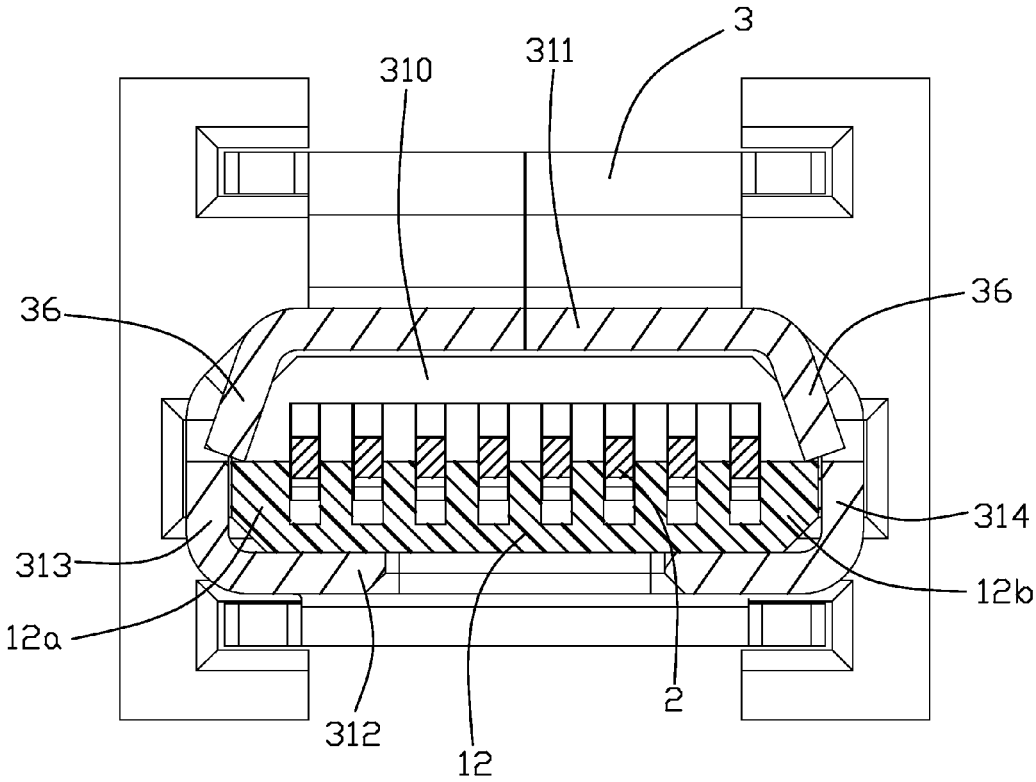
FIG. 4 is a cross-section view of the electrical connector taken along line 4-4 of FIG. 1.

Referring to FIGS. 1 and 4, the body portion 31 of the shell has a upper wall 311, a bottom wall 312 and a pair of side walls 313, 314 integrally connecting with the upper wall and the bottom wall, thereby surrounding the tongue portion. The shell 3 defines a pair of pressing portions 36 extending to the receiving space 310 and pressing against said tongue portion 12, so that the tongue portion is sandwiched between the pressing portion 36 and the bottom wall 312 in a vertical direction perpendicular to the tongue portion for preventing the tongue portion from distortion. The pair of pressing portions 36 is close to front side of the tongue portion 12 and defined at both side of the upper wall 311 in a transverse direction parallel to the tongue portion, for decreasing needed pressing force on the tongue portion. The pressing portion 36 is formed by a blade portion cut from the body portion or a tuber-shaped portion depressed from body portion simply, which is provided at each corner of the upper wall 311 with the side walls 313, 314.

The tongue portion 12 defines pressed walls 12*a*, 12*b* eudipleural at both sides of all terminals 2 in the transverse direction for corresponding to said pressing portions 36 of the shell and successfully using region of the tongue portion 12.

The terminal 2 includes a retaining portion 21 at a middle area thereof, a long contacting arm 23 extending from one end of the retaining portion for electrically connecting a mating member (not shown), and a soldering tail 25 extending from another end. The soldering tail is at a plane perpendicular to the retaining portion and the contacting arm for making the terminal soldered using SMT (Surface Mount Technology). The soldering tails of two adjacent terminals are separately at upside and downside thereof and for achieving a small dimension electrical connector. The spacer 4 is installed on the rear end 16 of the base portion and has a plurality of holes 41 for positioning said soldering tails 23. The locking portion 33 of the shell includes an extending portion 334 upholding a bottom side of the spacer 4 for preventing the spacer from moving downwards.

It is to be understood, however, that even though numerous characteristics and advantages of the present invention have been set forth in the foregoing description, together with details of the structure and function of the invention, the dislosure is illustrative only, and changes may be made in detail, especially in matters of shape, size, and arrangement of parts within the principles of the invention to the full extent indicated by the board general meaning of the terms in which the appended claims are expressed.

What is claimed is:

1. An electrical connector comprising:

an insulative housing comprising a base portion and an tongue portion cantilevered from the base portion and defining with a plurality of passageways extending from the base portion;

a plurality of terminals received in passageways of the tongue portion and the base portion;

a shell substantially surrounding the tongue portion to provide a receiving space between an upper surface of the tongue portion and the shell;

wherein the shell is configured with a cantilever-shaped pressing portion extending into the receiving space to press against said tongue portion in a vertical direction perpendicular to the tongue portion.

2. The electrical connector as described in claim 1, wherein the shell includes another pressing portion to cooperate with said pressing portion to commonly form a pair of pressing portions of the shell.

3. The electrical connector as described in claim 2, wherein the pair of pressing portions is defined at both side of the shell in a transverse direction and mechanically in contact with an area of the tongue portion having no terminal thereof.

4. The electrical connector as described in claim 3, wherein the pressing portion is formed by a blade portion that is cut from the shell.

5. The electrical connector as described in claim 3, wherein the pressing portion is formed by a tubular portion that is depressed inwardly from the shell.

6. The electrical connector as described in claim 3, wherein the tongue portion comprises pressed walls corresponding to said pressing portions of the shell at peripheral both side of all terminals in the transverse direction.

7. The electrical connector as described in claim 6, wherein the shell surrounds the tongue portion, thereby the pressed wall is sandwiched between the pressing portion of shell and a bottom wall of the shell in a vertical direction perpendicular to said transverse direction.

8. The electrical connector as described in claim 6, wherein the pressing portions are eudipleural in the transverse direction.

9. The electrical connector as described in claim 3, further comprising a spacer cover a rear end of the base portion that opposite to the tongue portion in the front-to-end direction perpendicular to the transverse direction.

10. The electrical connector as described in claim 9, wherein the terminal comprise a retaining portion at a middle area thereof, a long contacting arm extending from one end of the retaining portion at a same plane and a soldering tail extending from another end at a plane perpendicular to the retaining portion and being positioned in a plurality of holes defined by the spacer.

11. The electrical connector as described in claim 3, wherein the shell comprises a body portion shielding the tongue portion, a retaining tail retained in the base portion extending from the body portion and a locking portion engaging with two horizontal surfaces of the base portion.

12. An electrical connector comprising:

an insulative housing defining a main body and a mating tongue;

a plurality of passageways formed in the housing and exposed upon a front portion of the mating tongue;

a plurality of contacts disposed in the corresponding passageways, respectively; and a metallic shell having a front section covering the mating tongue and a rear section at least partially covering the main body; wherein the front section of said shell includes at least one pressing tang abutting against a mating face of said mating tongue above which said contacts extend.

13. The electrical connector as described in claim 12, wherein the pressing tang mechanically contacts an area of the mating tongue having no contacts thereof.

14. The electrical connector as described in claim 13, wherein said area is located around a lateral side of said mating tongue.

15. The electrical connector as described in claim 12, wherein the mating tongue includes another face opposite to the mating face, and said another face is supportably seated upon the front section.

16. The electrical connector as described in claim 12, the passageways are covered by a rear portion of the mating tongue in a vertical direction perpendicular to a front-to-back direction along which the connected is mated, so that the front section of the shell is intimately upward and downwardly supported by the rear portion of the mating tongue in said vertical direction.

17. The electrical connector as described in claim 16, wherein the passageways in one of upper and lower halves of said rear portion of the mating tongue transversely communicate with one another while those in the other half of the rear portion of the mating tongue do not.

18. The electrical connector as described in claim 12, wherein the front section of the shell is of a tubular shape with opposite long side and short side, and the pressing tang extends from the short side toward the long side.

19. An electrical connector comprising:

an insulative housing defining a main body and a mating tongue;

a plurality of passageways formed in the housing and exposed upon a front portion of the mating tongue;

a plurality of contacts disposed in the corresponding passageways, respectively, and defining contacting sections extending above a mating face of the mating tongue; and a metallic shell having a front section covering the mating tongue and a rear section at least partially covering the main body; wherein said mating tongue includes a front thin part exposing the corresponding passageways in a vertical direction perpendicular to front-to-back direction, and a rear thick part hiding the corresponding passageways in the vertical direction; wherein the front section of said shell is of a tubular shape defining opposite long and short sides thereof under condition that the short side intimately covers a rear portion of the mating tongue while being spaced from a front portion of the mating tongue while the whole long side intimately covers both the front portion and the rear portion of the mating tongue; wherein said front section of the shell is further equipped with a pressing tang abutting against the front portion of the mating tongue so as to cooperate with the long side of the front section of the shell for retaining the front portion of the mating tongue in position without distortion.

20. The electrical connector as claimed in claim 19, wherein the pressing tang extends from the short side toward the long side.

* * * * *